US005957763A

United States Patent [19]

Anderson, III et al.

[11] Patent Number: 5,957,763

[45] Date of Patent: Sep. 28, 1999

[54] POLISHING APPARATUS WITH SUPPORT COLUMNS SUPPORTING MULTIPLE PLATFORM MEMBERS

[75] Inventors: Robert L. Anderson, III, Scottsdale, Ariz.; Michael Manseau, Chicago, Ill.; Janusz Aleksander Derza, Prospect Heights, Ill.; John Edward Bussan, Libertyville, Ill.

[73] Assignee: Speedfam Corporation, Chandler, Ariz.

[21] Appl. No.: 08/932,578

[22] Filed: Sep. 19, 1997

[51] Int. Cl.[6] ..... B24B 7/04

[52] U.S. Cl. ..... 451/262; 451/269; 451/342

[58] Field of Search ..... 451/41, 63, 262, 451/263, 264, 265, 267, 268, 269, 285, 286, 287, 288, 290, 340, 342

[56] References Cited

U.S. PATENT DOCUMENTS

| | | | |
|---|---|---|---|
| 240,966 | 5/1881 | Chappell | 451/268 X |
| 1,838,553 | 12/1931 | Kadow et al. | 451/265 |
| 2,618,911 | 11/1952 | Indge . | |
| 2,688,215 | 9/1954 | Roshong et al. . | |
| 2,822,647 | 2/1958 | Rips et al. . | |
| 2,963,830 | 12/1960 | Hook . | |
| 2,979,868 | 4/1961 | Emeis . | |
| 3,225,492 | 12/1965 | Day et al. | 451/264 X |
| 3,537,214 | 11/1970 | Ford | 451/264 |
| 3,691,694 | 9/1972 | Goetz et al. | 451/269 |
| 3,791,083 | 2/1974 | Messerschmidt | 451/268 X |
| 3,848,365 | 11/1974 | Bovensiepen et al. . | |
| 3,898,770 | 8/1975 | Benz et al. . | |
| 3,925,936 | 12/1975 | Orlov et al. . | |
| 3,986,433 | 10/1976 | Walsh et al. . | |
| 4,007,560 | 2/1977 | Janssen | 451/262 |
| 4,194,324 | 3/1980 | Bonora et al. . | |
| 4,205,489 | 6/1980 | Orlov et al. . | |
| 4,315,383 | 2/1982 | Day . | |
| 4,459,785 | 7/1984 | Zimmer . | |
| 4,502,252 | 3/1985 | Iwabuchi . | |
| 4,592,169 | 6/1986 | Klievoneit et al. . | |
| 4,593,495 | 6/1986 | Kawakami et al. . | |
| 4,707,945 | 11/1987 | Arai . | |
| 4,742,651 | 5/1988 | Wittstock | 451/262 X |
| 4,773,185 | 9/1988 | Taira . | |
| 4,805,348 | 2/1989 | Arai et al. . | |
| 4,860,498 | 8/1989 | Gosis . | |
| 4,916,868 | 4/1990 | Wittstock . | |
| 4,962,616 | 10/1990 | Wittstock . | |
| 5,016,399 | 5/1991 | Vinson . | |
| 5,121,572 | 6/1992 | Hilscher | 451/262 X |
| 5,140,774 | 8/1992 | Onodera . | |
| 5,205,082 | 4/1993 | Shendon et al. . | |
| 5,329,732 | 7/1994 | Karlsrud et al. . | |
| 5,377,451 | 1/1995 | Leoni et al. | 451/287 |
| 5,595,529 | 1/1997 | Cesna et al. | 451/291 |
| 5,645,472 | 7/1997 | Nagahaski et al. | 451/261 |

OTHER PUBLICATIONS

SpeedFam–Spitfire Brochure entitled "Double–Sided Abrasive Machining System 360", Copyright 1994.

*Primary Examiner*—Timothy V. Eley
*Attorney, Agent, or Firm*—Fitch, Even, Tabin & Flannery

[57] ABSTRACT

A polishing machine includes a platform assembly slidably mounted on three support columns. The platform assembly includes first and second platforms captively joined together so as to be slidably movable toward and away from each other. A lift plate is supported above the uppermost platform by a coil spring and an upper polish plate is suspended from the lift plate by a supporting element which passes through the platform assembly. Drive shafts are suspended from an overlying superstructure and engage the upper platform so as to selectively raise and lower the platform assembly and the upper polish plate. The spring allows adjustment of the pressure applied by the upper polish plate.

20 Claims, 6 Drawing Sheets

POLISHING APPARATUS WITH SUPPORT COLUMNS SUPPORTING MULTIPLE PLATFORM MEMBERS

BACKGROUND OF THE INVENTION

1. Field of the Invention

The present invention pertains to polishing machines, and in particular to machines for imparting a well-defined finish to one or more workpieces. The present invention is especially adapted to the double-sided precision polishing of computer hard drive memory storage disks.

2. Description of the Related Art

Machines have been made available for providing a very smooth, well-defined surface finish on workpieces, such as computer hard drive memory storage disks. Although single-sided polishing has been performed to a limited extent, the commercial emphasis today is on the double-sided machining of memory disks, such that both major surfaces of a disk structure can be utilized for memory storage, thus reducing the size of memory devices, while allowing greater memory capacities to be provided for a hard drive component of a given size. Over time, the magnetic density of memory storage disks has grown substantially, with an ever increasing number of data bits being stored on a surface area of given size. As a result, data storage bits have occupied increasingly smaller portions of a disk surface. Accordingly, the surface characteristics of memory disks have drawn increasing attention, with routine, extremely well-defined polishing of the memory disk surface being required.

In an attempt to improve hard drive access times and memory transfer rates, memory storage disks are being driven at higher speeds of disk rotation. Accordingly, overall (or so-called "global") dimensions and tolerances of memory storage disks are becoming increasingly important for improved hard drive performance. Further, as disk speeds increase, it becomes necessary to hold the transducers, commonly termed "magnetic heads" as close as possible to the surface of the memory disk to obtain usable signal strength. Thus, increasing demands are being made to reduce total run out of the memory storage disks and surface variations of memory storage disks are being more closely examined with a view toward reducing "high spots" of ever diminishing height. Further, in certain types of hard disk drive mechanisms, parallelism of the double-sided surfaces is becoming increasingly important for attainment of desired device performance.

SUMMARY OF THE INVENTION

It is an object of the present invention to provide a high performance polishing machine that is inherently accurate, easy to use, and which is compatible with commercial manufacturing environments. It is important that such polishing machine be inherently stable during all phases of a polishing operation, without requiring special attention to changing conditions, and the effect that resulting excursions may have on the surface quality of the workpiece being treated.

In certain applications, it is required that the workpieces continue to rotate as polishing pressure is relieved and it is at these times that the polishing surfaces and the surrounding mechanism supporting those surfaces are permitted a certain freedom of movement. Any substantial misalignment or internal movement of the various cooperating components may result in unwanted contact of the polishing surfaces with the workpieces being treated, and it is an object of the present invention to control such contact.

It has been found important to examine the rigidity of the overall machine construction and to develop new structures for supporting the polishing members to eliminate unwanted motions, especially during critical moments, as when polishing pressure is in the process of being relaxed.

These and other objects of the present invention which Will become apparent from studying the appended description and drawing are provided in an apparatus for polishing a workpiece, comprising:

- a superstructure to receive support from a supporting surface;
- an upper polish plate;
- a lower polish plate positioned beneath said upper polish plate in registration therewith;
- platform means of generally triangular configuration disposed above said upper polish plate and supported by said superstructure;
- hanging support means for resiliently hangingly supporting the upper polish plate from the platform means; and
- means for moving said platform means and hence said upper polish plate toward and away from said lower polish plate.

DETAILED DESCRIPTION OF THE PREFERRED EMBODIMENTS

Figure 1:
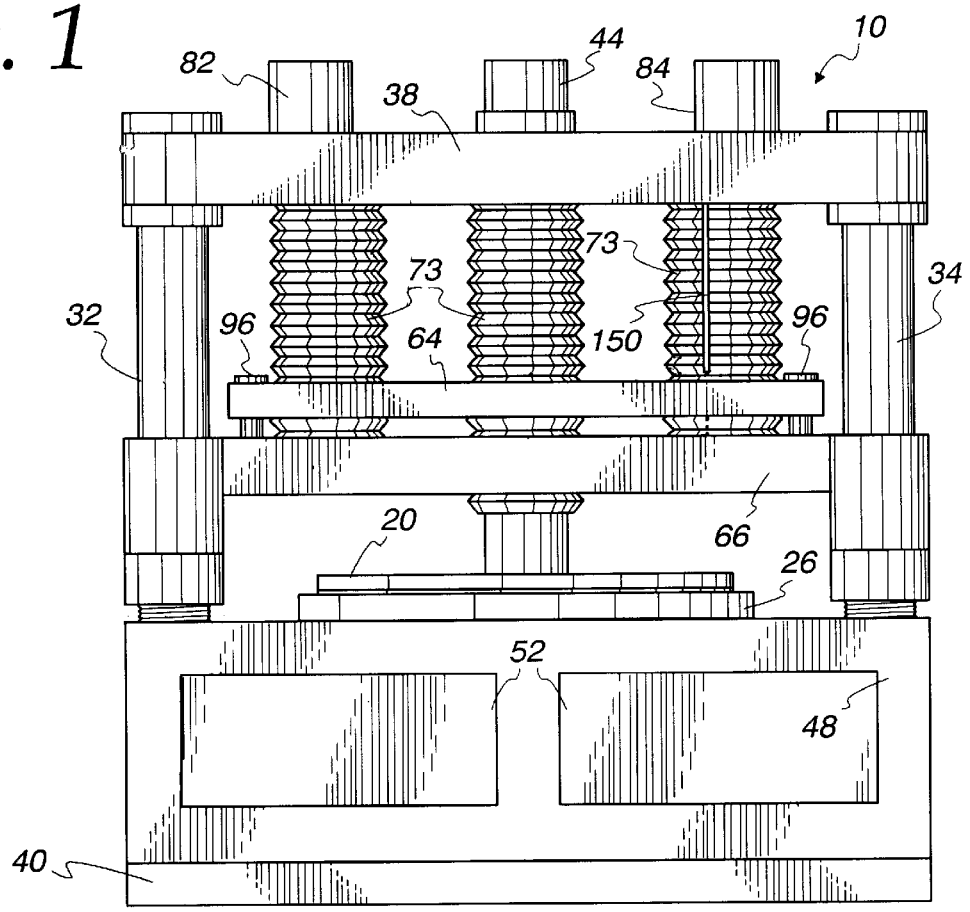
FIG. 1 is a side elevational view of a polishing machine according to principles of the present invention.
Figure 2:
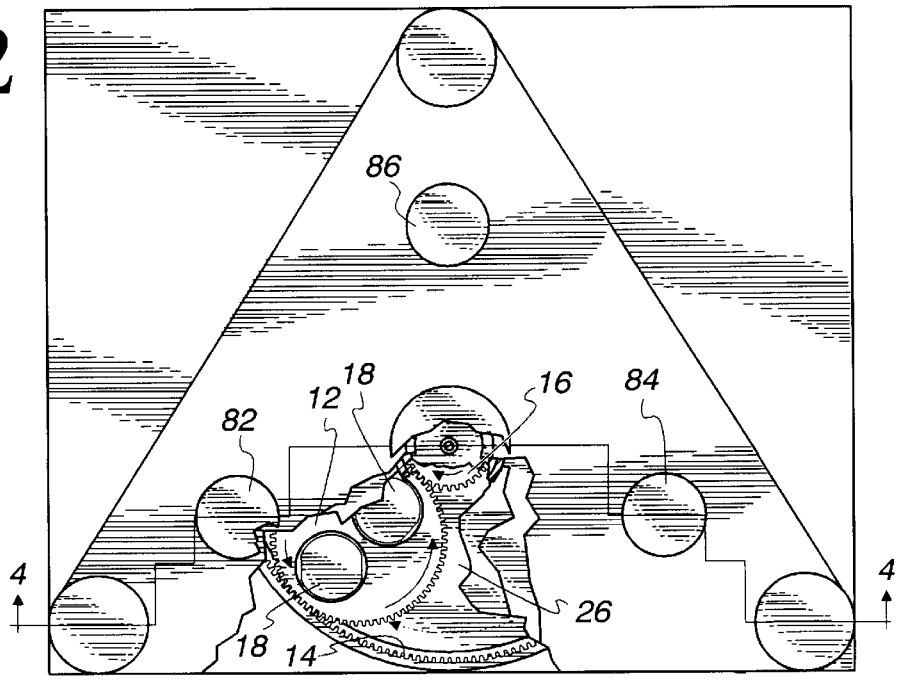
FIG. 2 is a top plan view thereof shown partly broken away.

Referring now to the drawings, a polishing machine according to principles of the present invention is generally indicated at 10. Machine 10 has found immediate commercial acceptance in the field of polishing memory storage disk substrates as well as the various layers formed thereon. It will be appreciated, however, that machine 10 can be readily adapted for other uses, including grinding, polishing, texturing and planarization of machine tool parts and integrated circuit wafers, for example.

In the preferred embodiment, a large number of workpieces, (e.g., fifty) memory disks, disk substrates, machine parts or other workpieces undergo simultaneous double-sided polishing, thereby providing important economies of manufacture for the machine user. In order to accommodate the large number of workpieces, work-cage mechanisms, including geared work holders or carriers 12 (see FIG. 3B), are employed to confine the workpieces during a polishing operation. It is generally preferred that the work-cage mechanisms be of the planetary type where a plurality of carriers 12 are made to revolve between an outer ring gear 14 and a central "sun" gear 16. The outer geared edges of the carriers are enmeshed with the central sun gear, which imparts a rotary motion to the carriers, so that the workpieces move in respective, generally cycloidal paths, revolving about the axis of their carriers, as the carriers rotate with respect to the axis of the central sun gear. Also, rotations of the upper and lower polish plates and of the work cage mechanism disposed between the polish plates can be operated in reverse directions of rotation, as desired. By regulating the directions and speeds of rotation of the sun and ring gears, as well as the upper and lower polish plates, virtually any desired polishing action may be obtained.

In the preferred embodiment, five memory disks 18 are loaded in each carrier, with ten carriers being intermeshed between the central sun gear and the outer, surrounding ring gear. Only two memory disks are shown in the figures for clarity of illustration. However, virtually any number of memory disks or other workpieces can be accommodated with appropriate changes in carrier design. The entire work-cage mechanism is rotated at an independently controllable speed, while the upper and lower polishing plates 20, 26 (see FIG. 3B, for example) are independently rotated at their own selected speeds.

As will be seen herein, the upper polish plate 20 is driven from above by a motor 44 (see FIG. 3A) while the lower polish plate 26 is driven from below in a conventional manner, by equipment contained in a hollow base cabinet 48. Access to the equipment for driving the lower polish plate through access doors 52, as can be seen in FIG. 1.

Figure 3A:
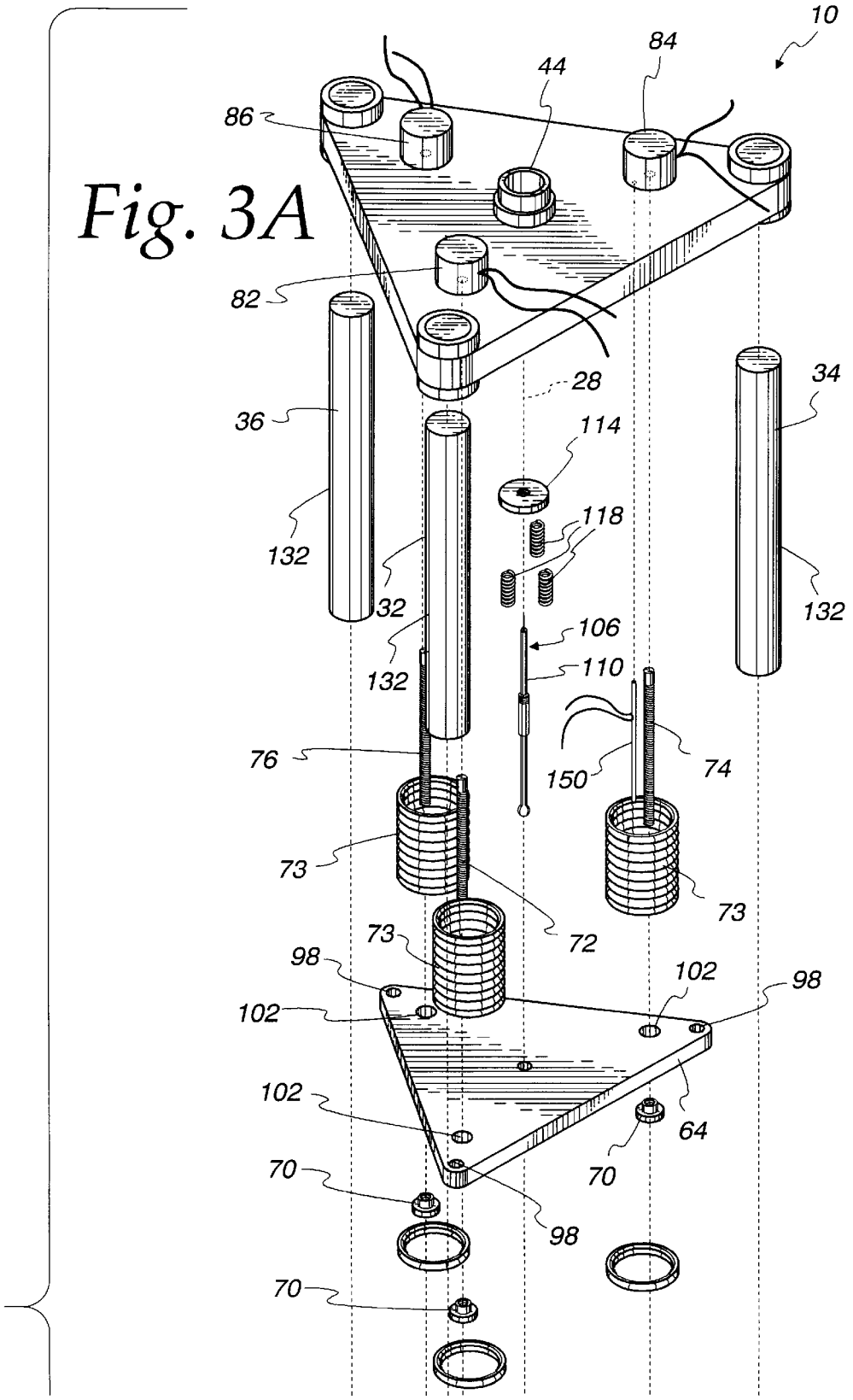
FIGS. 3A and 3B together comprise an exploded perspective view of the upper portion thereof.
Figures 3A, 3B:
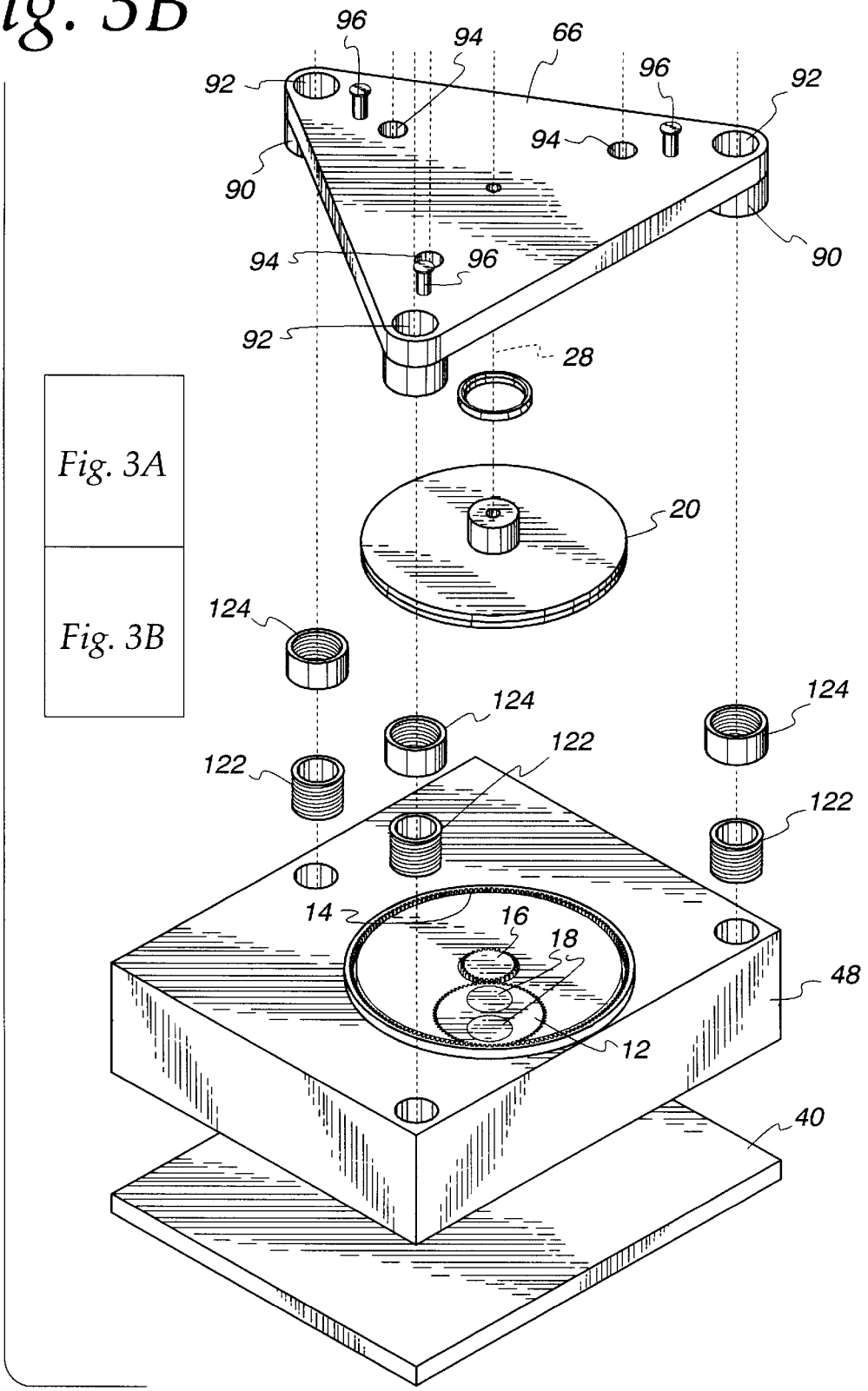

In the present invention is it preferred that the top and bottom polishing plates be provided with opposed annular polishing surfaces and that they be independently rotatably mounted along a single common axis (see dashed line 28 in FIG. 3B). It has been found that the attainment of a common axis alignment or so-called "focus" is important for obtaining the desired polishing results, especially when the geared cage mechanisms are made to undergo a complex motion, as in the preferred embodiment of the present invention. In order to improve the concentric alignment of upper and lower polishing plates and to ensure such alignment during various phases of machine operation, it is generally preferred that the structure supporting the top and bottom polishing plates have their positional locating elements milled in a common milling operation with the components mounted in their respective positions, one to another.

As will be seen herein, various members of the supporting superstructure have a generally triangular configuration. It is generally preferred, therefore, that three vertical support columns 32–36 be employed, with a triangular, generally horizontal top wall 38 extending between the upper ends of the columns (see FIG. 3A, for example). The base 40 of the framework is preferably made to have a generally rectangular shape (see FIG. 3B), although a three-sided generally triangular shape could also be employed.

Figure 4:
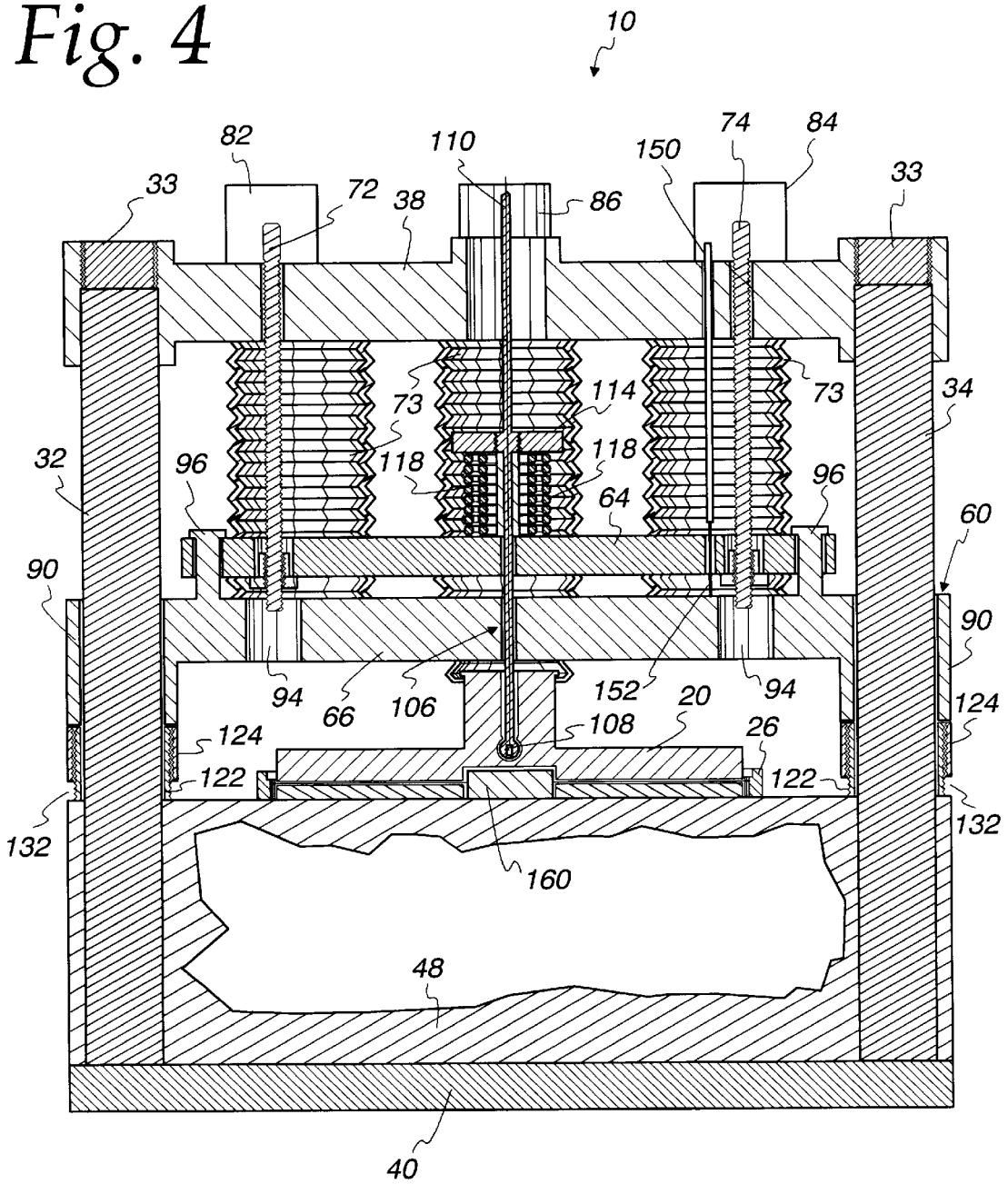
FIG. 4 is a cross-sectional view taken along the line 4—4 of FIG. 2.

Referring to FIGS. 3 and 4, the support columns 32–36 extend from top wall 38 and are supported from below, passing through base compartment 48 to machine base 40. A platform assembly generally indicated at 60 slides up and down along support columns 32–36 as can be seen, for example, in FIGS. 5 and 6. With reference to FIG. 4, the platform assembly includes a first, smaller, upper platform 64 dimensioned to fit within the support columns 32–36, and a second, larger, lower platform 66 dimensioned for sliding engagement with the support columns. Ball screw members 70 provide connection for platform member 64 with screw shafts or threaded rods 72–76. The threaded rods 72–76 are in turn supported from above by top wall 38 and are rotatably driven by drive motors 82–86. Thus, as motors 82–86 are energized to drive threaded rods 72–76, platform member 64 advances along threaded rods 72–76, being raised or lowered, depending upon the direction of rotation.

Referring again to FIG. 4, the second platform member 66 also has a generally triangular configuration as can be seen, for example, in FIG. 3B. Platform member 66 includes downwardly extending collar portions 90 located at its corners, cooperating with apertures 92 which slidingly receive the support columns 32–36. Platform 66 further includes apertures 94 for receiving the threaded rods 72–76. Platform member 66 further includes three upstanding lift pins 96 received in apertures 98 formed in platform member 64 (see FIG. 3A). With reference again to FIG. 3A, the platform member 64 further includes apertures 102 to provide clearance for the ball screw connectors 70. As can be seen, for example, in FIG. 4, lift pins 96 have enlarged heads which engage platform member 64 when platform member 64 is raised with respect to platform member 66. As indicated in FIG. 4, lift pins 96 have an axial length greater than the thickness of platform member 64, thereby allowing platform member 64 to slide back and forth along the lift pins 96.

Figure 9:
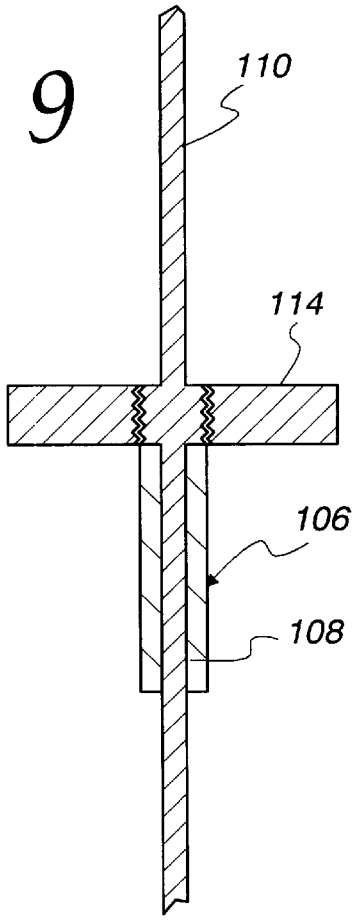
FIG. 9 is an enlarged fragmentary view of FIG. 4 showing suspension of the upper polish plate.

As mentioned, the upper polish plate 20 is hangingly supported from above. With reference to FIGS. 3, 4 and 9, a drive rod assembly generally indicated at 106 extends from the center of upper polish plate 20 in an upward direction. As schematically indicated in FIG. 4, the bottom end of drive rod assembly 106 is terminated at an interior portion of upper polish plate 20 with a gimbal assembly 108, which allows upper polish plate 20 to assume a canted position with respect to the axis of drive rod assembly 106. With reference to FIG. 9, drive rod assembly 106 includes an outer hollow sleeve 108 and a central drive rod 110 passing through platform members 64, 66 and top wall 38 for drive coupling with motor 44 (shown, for example, in FIG. 3A). Thus, as motor 44 is energized, drive shaft 110 causes upper polish plate 20 to rotate about its central axis. It is preferred that the drive rod assembly 106 passes through platform members 64, 66 in a frictionless manner so as to avoid interfering with balance and control functions of the polishing machine.

Referring again to FIG. 9, the outer hollow sleeve 108 of drive rod assembly 106 is joined to a lift plate 114 which is supported above platform member 64 by spring arrangement 116. Preferably, spring arrangement 116 comprises a plurality of spring members 118 disposed about drive rod assembly 106. Alternatively, spring arrangement 116 could comprise a single spring having a hollow center receiving the drive rod assembly or could comprise one or more spring/viscous damper combinations or other types of conventional deceleration controls. In either event, lift plate 114 is resiliently suspended above the upper surface of platform member 64. As previously mentioned, the outer hollow sleeve 108 is joined to lift plate 114 and thus the weight of upper polish plate 20 is borne by lift plate 114, being hangingly suspended therefrom. The weight of the upper polish plate 20 and its related components, such as the weight of the outer sleeve 108, causes spring arrangement 116 to become compressed between lift plate 114 and platform member 64.

Figure 10:
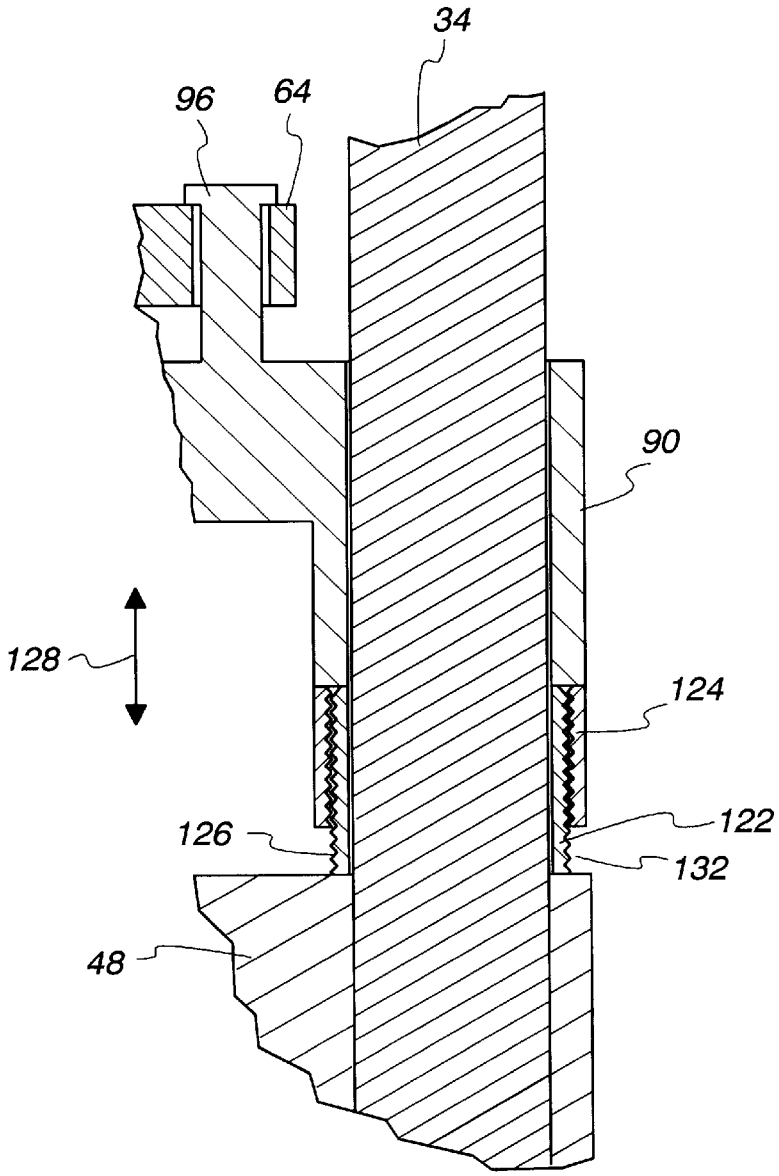
FIG. 10 is an enlarged fragmentary view of FIG. 4 showing an adjustable stop for the platform assembly.

Referring to FIGS. 3B and 10, bushing members 122 are provided at the upper end of hollow base 148. It has been found generally desirable to provide adjustable stops 124 for ready field adjustment and service for the platform assembly. Adjustable stop collars 124 have internal threads for engaging the external threaded surface portions 126 of bushing members 122. In this manner, the adjustable stop collars 124 can be moved up and down in the direction of arrow 128 (see FIG. 10) so as to limit downward movement of platform member 66 in a carefully defined manner. In FIG. 10, a relatively small gap 132 is shown between stop collar 124 and the upper shoulder portion of bushing 122, to provide an amount of adjustment for stop member 124. If desired, the adjustable stop feature can be omitted, with the upper surface of bushing 122 providing a stop surface for the platform assembly.

It is generally preferred, during assembly of machine 10, that the support columns 32–36 will be slidingly inserted through bushings 122. However, before construction of machine 10 is completed, the bushings 122 will be fixed at a desired position along the support columns, so as to provide a stationary reference for the movable stops 124.

In operation, polishing machine 10 undergoes certain distinct operating phases. For example, after workpieces are loaded in the work-cage mechanisms, the workpieces are pressed between upper and lower polish plates 20, 26. Initially, when the upper and lower polishing plates engage the major surfaces of the workpieces, higher pressures will be experienced by those workpieces which are slightly thicker than the rest. This condition lasts only for a brief time and thereafter the pressing force applied to the upper and lower polish plates is more equally distributed across each of the workpieces being processed.

With the arrangement of the present invention, polish pressure is obtained from the dead weight of the mechanism structure, rather than a pneumatic actuator or the like. It is generally preferred that the bottom polish plate 26 be maintained at a fixed vertical height with respect to base 40, and that the upper polish plate 20 alone be mounted for reciprocal movement in vertical directions. As will be appreciated by those skilled in the art, it is frequently desired to change the applied pressure during a polishing operation. With the arrangement of the present invention, polishing pressure can be gradually continuously adjusted in small increments and a relatively minute vertical adjustment of upper polish plate 20 is required to adjust polishing pressures.

Figure 5:
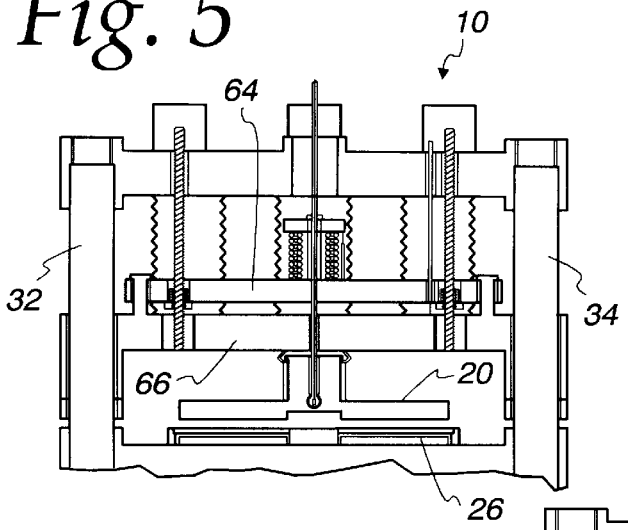
FIGS. 5–8 are views similar to that of FIG. 4, showing a sequence of operation.

When the polishing operation is completed, a much larger vertical movement of the upper polish plate 20 is required in order to gain access to the work-cage mechanisms. It has been found convenient to raise the upper polish plate 20 higher than would normally be allowed if the platform assembly 60 were fixed in position. Accordingly, it has been found convenient to mount the platform assembly 60 for reciprocation in vertical directions in order to facilitate loading and unloading of workpieces. Referring to FIG. 4, machine 10 is shown in a polishing position, with the opposed major surfaces of workpieces 18 being simultaneously polished by upper and lower polish plates 20, 26. When the polishing operation is complete, drive motors 82–86 are energized so as to rotate threaded shafts 72–76 causing ball screw connections 70 and hence platform member 64 to travel along threaded shafts 72–76 in an upward direction. With upward movement of platform member 64, the enlarged upper ends of lift pins 96 are engaged with platform member 66 being constrained to follow upward movement of platform member 64. As mentioned above, upper polish plate 20 and its associated mechanism is coupled to platform member 64 by spring arrangement 116. As platform member 64 is raised, an upward force is applied to the bottom end of spring arrangement 116, causing the spring arrangement to compress. Depending upon the spring constant(s) employed, during the lifting operation of platform member 64, an upward lifting force will be applied to lift plate 114 and, by reason of its connection to the outer sleeve 108, lifts the upper polishing plate 20 with the aforementioned components being simultaneously lifted toward top wall 38, providing increasing clearance between top and bottom polish plates as shown in FIG. 5.

Lifting of the above-mentioned mechanism occurs at the end of each polishing cycle of the machine, when polishing of the workpieces is completed, allowing their removal to a remote cleaning or storage station, for example. Fresh workpieces are then loaded into the cage mechanism in preparation for the initiation of a new polish cycle. The drive motors 82–86 are then energized so as to rotate in an opposite direction causing the ball screw connectors 70 to travel downwardly along threaded shafts 72–76. At this point in time, the platform member 66 and the upper polish plate 20 are hangingly suspended from platform member 64.

Figure 6:
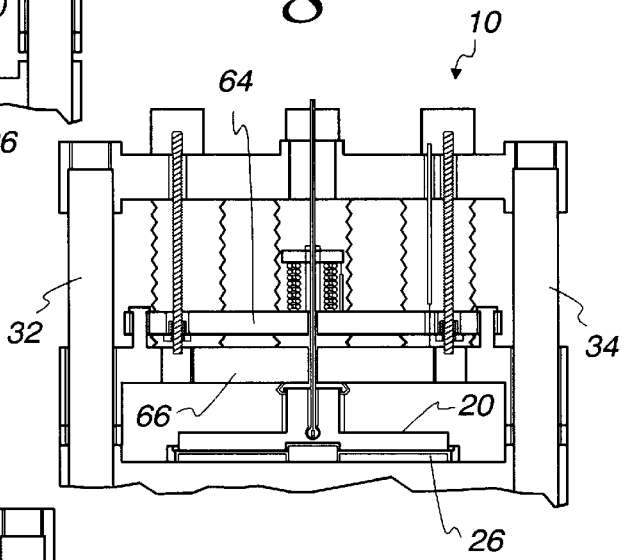

Platform member 64 bears the full weight of platform member 66, with the upper enlarged ends of lift pins 96 engaging platform 64 at its outer corners. Also, the full weight of upper polish plate 20 and its related component is borne by spring arrangement 116 which in turn is supported by platform member 64. With continued rotation of threaded shaft 72–76, the platform assembly and upper polish plate are lowered toward the lower polish plate 26 and the bottom of machine 10. Downward movement continues until the collar portions 90 contact adjustable stops 124, thus prohibiting further downward movement of lower platform 66, as indicated in FIG. 6. Although not visible in FIG. 6, at this point in the operation of machine 10, it is preferred that the upper polish plate 20 be spaced at least a small distance above lower polish plate 26 and the work-cage mechanisms carried thereon. Further, at this point in the operation of machine 10, the combined weight of the upper platform member 64, and of the upper polish plate 20 and its related components, is borne by threaded shafts 72–76.

Figure 7:
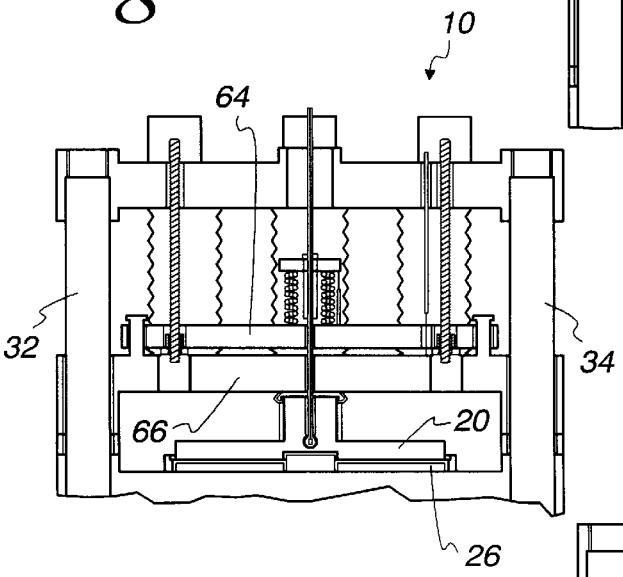

With continued rotation of threaded shafts 72–76, the upper platform member 64 is allowed to lower an additional amount, with its outer corners sliding along lift pins 96. As indicated in FIG. 7, this additional displacement of the threaded shafts 72–76 brings the upper polish plate 20 in contact with the workpieces. If desired, it is possible to detect an operating position, referred to as a "no load" position, where upper pressure plate 20 is about to contact the workpieces, an operating condition indicated in FIG. 7.

Figure 8:
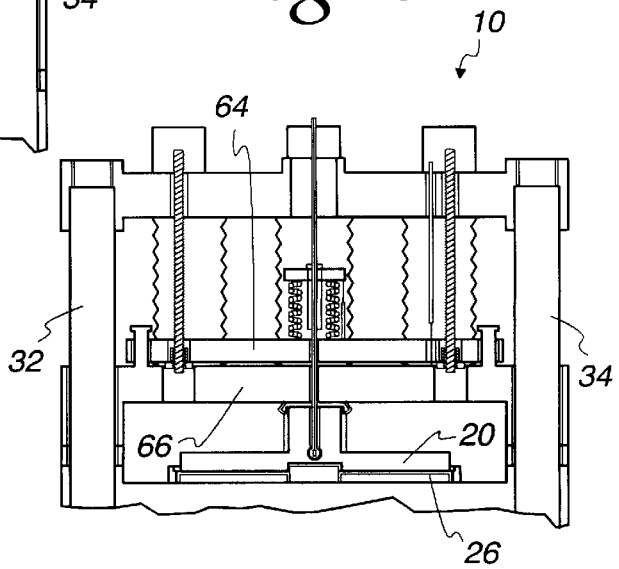

With continued rotation of threaded shafts 72–76 in the same direction, increasing proportions of the weight of upper polish plate 20 and its related components is allowed to be borne by the workpieces being polished, thereby providing increasing polishing pressures, as desired, a condition schematically indicated in FIG. 8. With relatively small displacements of threaded shafts 72–76 moving platform 64 up and down, the loading on spring arrangement 116 is made larger or smaller, thereby providing lesser and greater polishing pressures, respectively. If desired, the polishing pressure can be readily determined using known mathematical techniques based upon the effective spring constants of spring arrangement 116. It has been found helpful in this regard to continuously monitor the position of the upper platform member 64, during a polishing operation. A sensor 150 having an active portion 152 passing through platform 64, is provided. As shown in FIG. 4, the bottom end of sensor 150 is secured to platform member 66, for convenience of construction. As platform 64 is displaced with respect to platform 66, varying signals are detected in the active sensor portion 152 and transmitted by conductors contained within sensor 150, sending positional information of platform 64 to a computerized control device (not shown in the figures).

It has been found advantageous to provide exceptional stability for upper platform 64. Accordingly, lower platform 66 is made much more massive than is structurally required. In this manner, the lower platform member 66 (even if made mobile so as to be displaced with each polishing cycle) can, when seated on adjustable stop collars 124, be relied upon to provide a vibration-resisting fixed surface providing a stable reference for precisely controlled movements of platform member 64 and for providing a reference for the positional determination of the upper platform member. It has been found convenient in this regard to provide additional position locating means to guide lower platform member 66 at its moment of contact with the adjustable stop member, thereby improving the reliability of repeatably positioning the platform assembly with respect to the central axis of the lower pressure plate 26.

For example, an upwardly directed diamond-shaped pin can be mounted to one side of adjustable stops 124 for mating engagement with a plate extending from one side of column members 90 and containing an aperture for receiving the diamond pin, thereby positioning the platform assembly 60 with respect to the base 48 (and hence the central axis of lower pressure plate 26) to a very close tolerance. It is useful to note, in this regard, that FIG. 4 includes a schematic indication of additional members for the accurate registration of upper and lower pressure plates 20, 26. As shown in the central portion of FIG. 4, a pin member 160 extends in an upward direction, passing through the hollow center of lower pressure plate 26. Pin 160 is received in a downwardly facing recess formed in the center of upper pressure plate 20. In this manner, as upper pressure plate 20 is moved to bear against workpieces carried on lower pressure plate 26, alignment pin 160 is received in the upper pressure plate with a close tolerance fit, to bring the upper and lower pressure plates into coaxial alignment with one another and preferably, into alignment with the central axis of machine 10.

With reference again to FIG. 4, flexible bellows covers 73 surround the moving mechanisms, to provide an extra measure of security for nearby personnel. Machines constructed according to principles of the present invention have been made to have a total height less than 10 feet and a relatively small footprint (6 foot square) and have thus been found convenient for use in clean room environments. In the preferred mode of assembly, the collars 90 and platform 66 are joined together prior to milling common apertures for receiving the support columns 32–36. Preferably, the top wall 38 is positioned atop the platform member 66 and internal support members (not shown in the drawings) located adjacent base 40 are also positioned with platform 66 atop wall 38 for a common milling operation so as to receive support columns 32–36 with a close tolerance accuracy. Accordingly, as can be seen in FIG. 4, through-holes are formed in top wall 38 for receiving support columns 32–36 and end caps 33 are threadingly joined to top wall 38 so as to hold the support columns 32–36 captive.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. An apparatus for polishing a workpiece, comprising:

a superstructure;

an upper polish plate;

a lower polish plate positioned beneath said upper polish plate;

platform means disposed above said upper polish plate and supported by said superstructure;

hanging support means for resiliently hangingly supporting the upper polish plate from the platform means;

means for moving said platform means and hence said upper polish plate toward and away from said lower polish plate; and said polishing means comprise first and second platform members which have a generally triangular configuration and said superstructure includes a generally triangular top wall providing hanging support for said upper polish plate.

2. The polishing apparatus of claim 1 wherein said platform means defines a central passageway through which said hanging support means passes.

3. The polishing apparatus of claim 2 further comprising a plurality of stop blocks supported by said superstructure so as to interfere with said platform means so as to limit the movement thereof, and so as to support said platform means at a fixed position above said upper polish plate.

4. The polishing apparatus of claim 3 wherein said platform means comprises first and second platform members disposed one above the other.

5. The polishing apparatus of claim 4 wherein said stop blocks are adjustably positionable with respect to said superstructure.

6. The polishing apparatus of claim 4 further comprising linking means linking said first and second platform members together to allow said first and second platform members to move away from each other a defined, maximum amount.

7. The polishing apparatus of claim 6 wherein said linking means comprise a plurality of lift pins extending from one of said first and said second platform members and received in apertures formed in the other of said first and said second platform members.

8. The polishing apparatus of claim 1 wherein said hanging support means comprises a central shaft having a lower end affixed to said upper polish plate and having a central axis, with means for mounting the central shaft for rotation about its central axis, and an outer sleeve means disposed about said central shaft.

9. The polishing apparatus of claim 1 further comprising cooperating alignment means on said upper and said lower polish plates to align said upper and said lower polish plates in registration as said upper and said lower polish plates are brought together.

10. The polishing apparatus of claim 1 wherein said upper polish plate has a central axis and said polishing apparatus further comprises means for rotating said upper polish plate about said central axis.

11. The polishing apparatus of claim 1 further comprising cooperating sun gear means, ring gear means and a plurality of geared carrier means coplanar aligned with and disposed between said sun gear means and said ring gear means, with said sun gear means, said ring gear means, and said plurality of geared carriers are carried on said bottom polish plate.

12. An apparatus for polishing a workpiece, comprising:

a superstructure;

an upper polish plate;

a lower polish plate positioned beneath said upper polish plate;

platform means disposed above said upper polish plate and supported by said superstructure, said platform means including first and second platform members, with the first platform member disposed above the second platform member;

linking means linking said first and second platform members together to allow said first and said second platform members to move away from each other a defined, maximum amount;

hanging support means for hangingly supporting the upper polish plate from the first platform member, said second platform member defining a central passageway through which said hanging support means passes;

a plurality of stop blocks supported by said superstructure so as to interfere with said second platform member so as to limit the movement thereof, and so as to support said second platform member at a fixed position above said upper polish plate; and resilient bias means coupling said hanging support means and said first platform member; and means for moving said first platform member toward and away from said lower polish plate to bring said upper polish plate into contact with said workpiece with a polishing pressure and to control the polishing pressure.

13. An apparatus for polishing a workpiece, comprising:

a superstructure;

an upper polish plate;

a lower polish plate positioned beneath said upper polish plate;

platform means disposed above said upper polish plate and supported by said superstructure, said platform means including first and second platform members, with the first platform member disposed above the second platform member;

hanging support means for hangingly supporting the upper polish plate from the first platform member, said second platform member defining a central passageway through which said hanging support means passes;

a plurality of stop blocks supported by said superstructure so as to interfere with said second platform member so as to limit the movement thereof, and so as to support said second platform member at a fixed position above said upper polish plate; and resilient bias means coupling said hanging support means and said first platform member;

means for moving said first platform member toward and away from said lower polish plate to bring said upper polish plate into contact with said workpiece with a polishing pressure and to control the polishing pressure;

said hanging support means comprising a shaft having a lower end affixed to said upper polish plate and having a central axis, with means for mounting the central shaft for rotation about its central axis, and an outer sleeve means disposed about said central shaft, engaging said resilient bias means; and a lifting platform disposed above said first platform member and wherein said resilient bias means is mounted atop said first platform member, supporting said lifting platform from below.

14. An apparatus for polishing a workpiece, comprising:

a superstructure;

an upper polish plate;

a lower polish plate positioned beneath said upper polish plate;

platform means disposed above said upper polish plate and supported by said superstructure, said platform means including first and second platform members, with the first platform member disposed above the second platform member;

said first and said second platform members have a generally triangular configuration and said superstructure includes support columns passing through apertures formed in said second platform member so as to provide sliding support therefor;

hanging support means for hangingly supporting the upper polish plate from the first platform member, said second platform member defining a central passageway through which said hanging support means passes;

a plurality of stop blocks supported by said superstructure so as to interfere with said second platform member so as to limit the movement thereof, and so as to support said second platform member at a fixed position above said upper polish plate; and resilient bias means coupling said hanging support means and said first platform member; and means for moving said first platform member toward and away from said lower polish plate to bring said upper polish plate into contact with said workpiece with a polishing pressure and to control the polishing pressure.

15. The polishing apparatus of claim 14 wherein said superstructure includes a generally triangular top wall providing hanging support for said upper platform member and said means for moving said first platform member toward and away from said lower polish plate comprise platform hanging means for hangingly supporting said first platform member from said top wall.

16. The polishing apparatus of claim 15 wherein said platform hanging means comprises a plurality of rotatively driven rods threadingly engaging said first platform member.

17. The polishing apparatus of claim 14 further comprising linking means linking said first and second platform members together to allow said first and said second platform members to move away from each other a defined, maximum amount.

18. The polishing apparatus of claim 17 wherein said linking means comprise a plurality of lift pins extending from one of said first and said second platform members and received in apertures formed in the other of said first and said second platform members.

19. The polishing apparatus of claim 14 wherein said hanging support means comprises a shaft having a lower end affixed to said upper polish plate and having a central axis, with means for mounting the central shaft for rotation about its central axis, and an outer sleeve means disposed about said central shaft, engaging said resilient bias means.

20. The polishing apparatus of claim 19 further comprising a lifting platform disposed above said first platform member and wherein said resilient bias means is mounted atop said first platform member, applying an upward support force to said lifting platform.

* * * * *